United States Patent [19]

Howey et al.

[11] Patent Number: 4,610,352

[45] Date of Patent: Sep. 9, 1986

[54] NONWOVEN FABRIC

[75] Inventors: Jon A. Howey, Mansfield; Randall J. Rogers, Millis, both of Mass.

[73] Assignee: The Kendall Company, Boston, Mass.

[21] Appl. No.: 730,987

[22] Filed: May 6, 1985

Related U.S. Application Data

[63] Continuation-in-part of Ser. No. 546,785, Oct. 28, 1983, abandoned.

[51] Int. Cl.[4] ..... B65D 85/30

[52] U.S. Cl. ..... 206/313; 206/444; 428/172; 428/198; 428/284; 428/287; 428/296

[58] Field of Search ..... 428/198, 171, 172, 284, 428/287, 249, 296, 902; 206/313, 444

[56] References Cited

U.S. PATENT DOCUMENTS 4,211,227 7/1980 Anderson et al. ..... 428/198

*Primary Examiner*—James J. Bell

*Attorney, Agent, or Firm*—Edward J. Scahill, Jr.

[57] ABSTRACT

Nonwoven fabrics are described comprising a layered fabric having an inner layer of substantially thermoplastic material, for example Nylon 6 fibers, disposed adjacent and recessed bonded to at least one outer layer or a pair of outer layers of textile length fibers by means of heat and pressure. The thermoplastic fibers in the inner layer have a lower melting point than the outer fibers in the fabric. A nonwoven fabric constructed in this manner has qualities of; low levels of debris, high compressibility, low abrasiveness, and dimensional stability. These qualities are decidedly of use in many products, most particularly as a liner in computer diskettes, wherein a liner material must be used to wipe the magnetic disk within the computer diskette to keep it free of foreign particles, which may cause errors in the transfer of information onto or from the magnetic disk.

7 Claims, 6 Drawing Figures

NONWOVEN FABRIC

This Application is a continuation-in-part of U.S. Application Serial Number 546,785, filed October 28, 1983, now abandoned.

BACKGROUND OF INVENTION

This invention relates to a nonwoven fabric used as a wiping medium of a magnetic recording medium known as a computer diskette, which comprises a flexible magnetic recording disk contained in an envelope, having a wiping fabric attached therein.

The importance of nonwoven fabrics in computer diskettes is now recognized as being more than a protective fabric to minimize wear or abrasion of the magnetic media. The wiping action of the fabric is important to the function of the floppy disk medium which stores information for use in a disk drive. The wiping action of the fabric is also important because debris that may interfere with the information transfer at the read-write head of the computer disk drive, is ideally removed and entrapped by a wiping fabric. Debris originates from many sources such as; the diskette manufacturing process; the envelope itself; the action of the read-write head on the magnetic disk; external environment; and, abrasion of the magnetic disk, caused by abrasive fibers used in making nonwoven wiping fabrics.

While there is a demonstrated need for a wiping medium to keep the magnetic disk clean in order to reduce errors in the transmission of information onto or from said magnetic disk, the prior art does not indicate what characteristics are needed in a wiping fabric to perform this task.

The fabric that would perform such a task must be constructed in such a manner that fibers used in the fabric would not themselves produce debris in the process of making the fabric. The fibers used therein should not be abrasive to the magnetic disk in which it would come in contact. If debris created by abrasion is not removed or if the wiping fabric abrades the magnetic disk producing foreign particles then said foreign particles will impinge upon the surface, or remove the surface of the magnetic disk. Such abrasion or removal of the surface causes errors in the information that is being transferred from or onto a magnetic disk, and a misreading of said information would take place.

U.S. Pat. No. 3,668,658 discloses a magnetic record disk cover wherein any porous low friction anti-static material is used to wipe the surface of the magnetic media.

In addition, U.S. Pat. No. 4,239,828 discloses a self-lubricating magnetic recording diskette, wherein a nonwoven porous tissue-like material is impregnated with a specific additive to lubricate the surface of the magnetic media to prolong the life of the disk.

Although the prior art outlines the need for a wiping fabric to keep the magnetic disk or media used in computer diskettes free from foreign particles in order to reduce errors in information transfers, it is only concerned with enveloping the magnetic disk in a cover to reduce the amount of external contamination that may settle on the magnetic record surface, or the lubricating of the surface of the magnetic disk to reduce contamination and extend the life of said magnetic disk. However, the prior art does not take into account other problems that exist in providing error free performance in the transfer of information onto or from a magnetic disk. There is also a problem of debris caused by loose particles inherent in the use of certain fibers in nonwoven fabrics that may be used as wiping mediums in a recording diskette. Another problem is caused by abrasiveness in the pressure pad area of the computer diskette. For the purpose of this invention, a pressure pad is defined as an external mechanism which is part of the information recording system being used. One such system operates by sending an electric impulse to a solenoid, which in turn moves a pressure pad into a position adjacent the read-write head of the computer disk drive and puts it in contact with the computer diskette, thereby exerting pressure onto the diskette envelope and pushing the envelope and attached wiping medium onto the magnetic medium, allowing the wiping medium to clean the magnetic disk, while information is being transferred. The pressure pad exerts substantial pressure on the wiping fabric, which is in contact with the magnetic disk's surface, in order to entrap debris created by the read-write head. The pressure exerted by the pressure pad presents a problem. This problem develops when pressure exerted by the pressure pad on the computer diskette is transferred to the wiping fabric. This combination of force and fabric friction within a computer diskette may possibly slow the magnetic disk, thus causing poor transfer of information from the recording system to the disk. Additionally, as mentioned before hand, the pressure of the read-write head on the magnetic disk contributes to abrasion of said disk due to the numerous cycles that the disk has to go through with the read-write head pressing down on said magnetic disk causing debris. Another problem that exists in wiping fabrics, which is caused in the production of these fabrics, is dimensional creep. Dimensional creep is a disadvantage because it changes dimensions of a fabric for example; dimensional creep exists when a fabric is altered, by cutting it while it is under tension. If the fabric remains under tension its dimensions remain the same as they were when cut. Once the tension is removed from the fabric and it relaxes, its dimensions change due to the fabric's memory of what its dimensions were prior to being put under tension. Thus, when the fabric is cut to mate with diskette components it does not retain its dimensions after the tension is removed, and may be rejected. The present invention substantially overcomes all the disadvantages prevalent in the prior art by providing a fabric that significantly reduces errors in the transmission of information onto or from a computer magnetic disk, by reducing foreign contamination and providing a fabric that is: substantially free of fiber debris; non-abrasive; highly compressible; and has dimensional stability. These characteristics are needed in a liner fabric, to overcome problems associated with providing error free transfer of information from or onto a magnetic disk.

SUMMARY OF THE INVENTION

The present invention is a nonwoven fabric comprising an inner layer of substantially low melting thermoplastic material, such as Nylon 6 fibers, disposed adjacent, and thermally bonded to, at least one outer layer of substantially non-thermoplastic textile length fibers. This particular type of layered construction advantageously results in a fabric wherein the lower melting point thermoplastic fibers bonds themselves and the non-thermoplastic textile length fibers or combinations thereof together at several discrete and recessed bonding points by heat and pressure or other similar bonding methods. During the bonding process, only the low melting thermoplastic material melts and bonds the non-thermoplastic textile length fibers together at bond points which will be recessed beneath or below the outer surface of the fabric. Therefore, because the non-thermoplastic textile length fibers do not melt, these softer textile fibers are left essentially untouched and in position at the outer surface of the fabric outside the bond points, giving the fabric a structure which is lofty and soft. Enhanced softness of the fabric can be achieved with the use of non-thermoplastic textile length fibers, especially those fibers having the delusterant removed therefrom.

An object of this invention is to provide a fabric that is substantially free of debris.

Still another object is to provide a fabric whose dimensions remain stable after being cut under tension, thus reducing dimensional creep and fabric waste.

In addition another object is to provide a fabric with high compressibility that will distribute the pressure pad load more evenly, substantially minimizing wear of the magnetic media and reducing abrasive contact.

It is still another object to provide a fabric with low surface resistivity, thus reducing the buildup of static electricity within the rotating magnetic disk.

Another object is to provide a fabric having at least 75% void volume, which allows for the entrapment of external dirt and debris.

DESCRIPTION OF THE PREFERRED EMBODIMENTS

Figure 1:
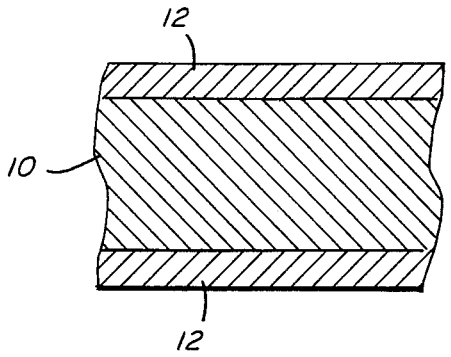
FIG. 1 is a cross sectional view of the layered structure of the invention prior to bonding.
Figure 2:
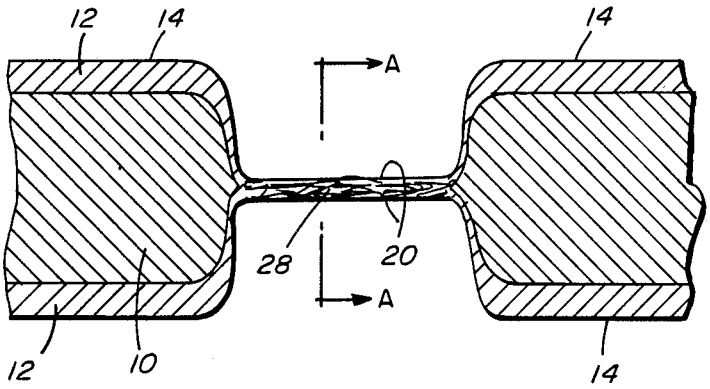
FIG. 2 is a cross sectional view of the fabric of the invention after bonding has occurred.

Referring to the drawings, FIG. 1 shows a layered fabric wherein an inner layer of substantially thermoplastic Nylon 6 fibers 10, has at least one outer layer 12 of substantially textile length cellulosic fibers or a combination of Nylon 6 and cellulosic fibers in bonded contact therewith. Although any thermoplastic fiber may be used, the preferred fiber is Nylon 6. Nylon 6 (polycaprolactam) is a long synthetic polyamide in which less than 85% of the amide linkages are attached directly to two aromatic rings. Nylon 6 fibers are now available from a number of companies. As shown, the preferred fabric has an outer layer 12 disposed on either side of inner layer 10. The thermoplastic Nylon 6 fibers of said inner layer 10 have a lower melting point than the non-thermoplastic textile length fibers in said outer layer(s). Non-thermoplastic textile length fibers are selected from the group comprised of rayon, cotton, and other cellulosic fiber, rayon being the preferred fiber. The inner and/or outer layers may also be blends of thermoplastic and non-thermoplastic fibers. The layers are bonded together at various discrete bonding points by various methods including but not limited to, heat and pressure or ultrasonics. During the bonding procedure, sufficient heat is used to cause a melting or softening of only the low melting thermoplastic fibers in these recessed discrete bonding areas. The fiber displacement pattern formed by bonding is shown in FIG. 2 in an exaggerated manner wherein bonding areas 20 are disclosed.

While FIG. 1 shows the preferred embodiment of an inner layer of thermoplastic Nylon 6 fibers sandwiched between a pair of outer layers of non-thermoplastic rayon textile length fibers, it should be understood that a single outer layer can be successfully used herein with similar although perhaps somewhat less desirable results.

This unique liner construction described above results in a fabric that has low levels of debris, high compressibility, low abrasiveness, dimensional stability, and low surface resistivity. These characteristics are highly desirable in a wiping fabric used in the computer industry. More particularly, they are desirable in a computer diskette liner whose purpose is to reduce errors in the transfer of information to or from a computer magnetic disk by wiping clean the surface of the magnetic disk. The present invention is a significant advance in the diskette liner field, because none of the aforementioned characteristics are even discussed in the prior art.

As mentioned previously, this fabric has a structure which results in a lofty and soft fabric. Advantages of the fabric being lofty and soft are many, such as: the fabric is suitable to clean a magnetic disk in a computer diskette of foreign particles; the fabric is also substantially nonabrasive to the magnetic disk, because the non-thermoplastic fiber that comes in contact with the surfaces of the magnetic disk has unmelted, nonabrasive qualities; this fabric may be compressed giving excellent contact between the wall of the diskette envelope and the magnetic disk without exerting excessive pressure against either the envelope or the disk. Because the outer surfaces of the fabric are not themselves bonded but are only bonded at recessed bond points due to the low melting fiber in said inner layer, the fabric is allowed to remain lofty thus giving the fabric compressibility. This is a desired characteristic because the fabric may be compressed to fit in a particular computer diskette envelope. An envelope for the purpose of this invention may be defined as a container housing flexible magnetic media. As a result of compressibility of the fabric, low pressure is exerted between the envelope and the magnetic disk. If high pressure were to be used, abrasion of the magnetic media by the liner could take place. One further advantage of this construction is the resulting low levels of debris in the fabric due to the way it is bonded. The recessed bonding areas of the low melting thermoplastic fiber to the non-thermoplastic fibers hold the inner and outer layers together allowing substantially no debris to exit from the fabric.

Figure 6:
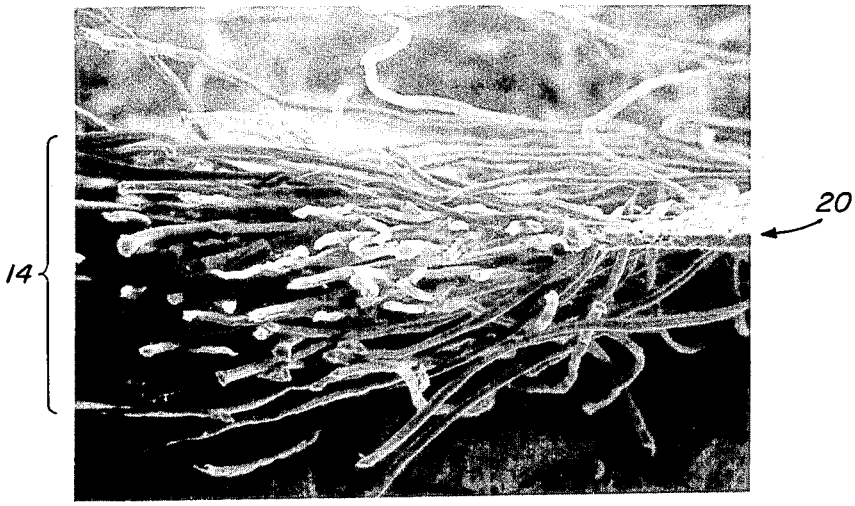
FIG. 6 is a microphotograph illustrating the bonded and unbonded areas of the fabric.

A result of this invention, created by its point bonded structure is the capability of this fabric to have at least a 75% void volume which allows for the entrapment of dirt and debris. By having such a large void volume, additional assistance in reducing errors in transmitting of information is achieved. This is illustrated in FIG. 6. Void volume as herein used, may be defined as the open space between fibers.

The importance of this soft, lofty, non-abrasive, dimensionally stable, compressible, low level debris fabric is readily noticeable in the computer industry because without a fabric having these qualities, errors would occur in the transmission of information from or to a computer diskette which would wreak havoc among the users of computer diskettes. If significant errors in transmitting do take place, it becomes obvious that information being transferred may become lost and not recoverable, or it is distorted on the recording medium. The present invention fabric substantially decreases the cause of errors thus giving virtually an error free performance to the user.

Figure 4:
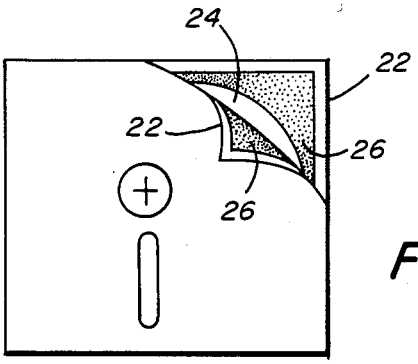
FIG. 4 shows the fabric of this invention in place in a computer diskette.

To assist in understanding the function of the present invention, a description of a computer diskette as illustrated in FIG. 4 is given. A computer diskette is comprised of a plastic outer envelope or jacket 22, a magnetic disk 24 and the nonwoven liner 26 of this invention attached to the envelope. The diskette is used as a recording medium to record information, similar to a cassette tape used in tape recorders. The magnetic disk 24 is sandwiched between two nonwoven liners 26, such as the present invention, while the envelope 22 encloses these components to keep out contamination.

Figure 5:
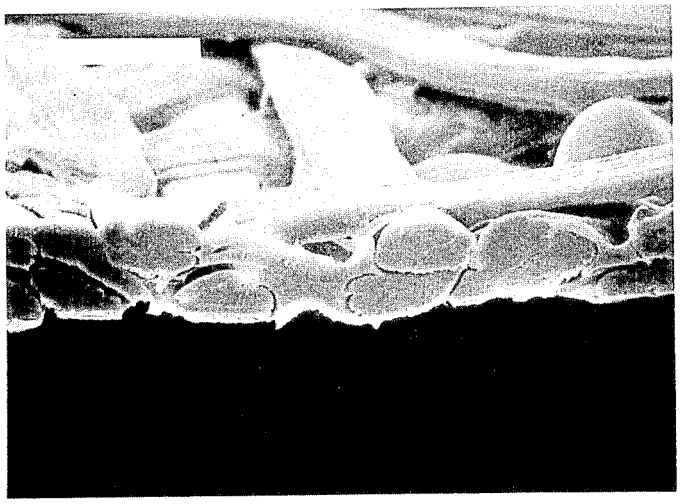
FIG. 5 is a microphotograph illustrating the bonding of fibers.

The purpose of layering and bonding as hereinbefore described and shown in the drawings is to isolate the abrasive bonded and melted thermoplastic fibers 10, as illustrated in the drawings, away from the surface of the fabric so as to eliminate any possibility of abrasion of the surface of a computer magnetic disk by the liner fabric. The thermoplastic fibers 10 are isolated by a recessed bonding technique, wherein, for example specific heat and pressure levels are applied to the layered construction, causing the inner layer of low melting fibers 10 to melt and encapsulate the innermost portion of the non-thermoplastic textile length fibers 12 used in the outer layers, as illustrated in FIG. 5, a micro photograph of the present fabric. It has unexpectedly been found that Nylon 6 fiber, when used as the inner layer of fibers in the present invention, does an excellent job of encapsulating the outer textile length rayon fibers, and gripping them. Many other thermoplastic fibers have been tried, and they have encapsulated the rayon, but no other thermoplastic fiber has even approached the amount of encapsulation and substantial gripping and bonding that is achieved by the use of Nylon 6 fiber. This unexpected bonding strength is also obtained with non-layered configurations or homogeneous blends of the Nylon 6 and non-thermoplastic fibers. For example, a homogeneous blend of rayon and Nylon 6 fibers that are thermally bonded by the Nylon 6 yield tensile strengths that are double those of fabrics made from blends of rayon fibers using bonding agents of polypropylene fibers, or polyethylene terephthalate fibers, or Nylon 6, 6 fibers. Not only are the tensile strengths double using Nylon 6 as the thermoplastic bonding agent, but the level of Nylon 6 required in the fiber blend to yield adequate bonding and encapsulation is substantially below the levels required for polypropylene, polyethylene terephthalate, or Nylon 6, 6. This bonding phenomenon takes place only in the areas where the fabric is recessed, further illustrated in FIG. 6, a microphotograph of a cross sectional area of the present fabric. The reason this happens in the recessed bond areas is due to the fact it is the only place where the combination of heat and pressure is present. At the raised or unbonded areas 14 of the nonrecessed outer layers of the fabric only controlled amounts of heat come in contact with the lower melting fibers, thus, causing little, if any, physical change at the raised areas of the fabric. This selective recessed bonding technique therefore leaves the soft unmelted textile length fibers 12 at the surface of the fabric, a construction which allows only the soft textile length fibers 12 to come in contact with the surface of a magnetic disk 24 while the melted and abrasive bonded fibers are recessed away from the disk surface. As expressed previously, this is important, because it allows the lofty and soft fabric to more efficaciously clean the surface of the magnetic disk while not abrading it. In addition, securing of the thermoplastic and non-thermoplastic textile length fibers, together at the recessed bond points, substantially reduces any fiber debris that usually results when producing nonwoven fibrous material.

Figure 3:
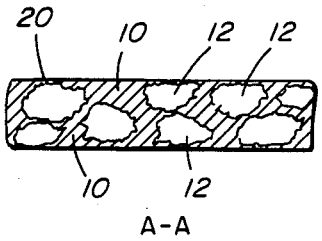
FIG. 3 is a sectional view of FIG. 2 along A—A.

FIG. 2 is a cross sectional view of the bonded fabric illustrating that the recessed bonded areas 20 are substantially thinner (i.e. 15 to 25 times thinner) than the unbonded regions 14 of the fabric. The ratio of the thickness of the bond area to the unbonded area will vary depending on the weight of the fabric being made. It is further shown in FIG. 2 that the fibers in the unbonded regions 14 maintain their layered structure with the thermoplastic fibers 10 remaining sandwiched between the outer layers of the non-thermoplastic textile length fibers 12. FIG. 3 is a cross-sectional view which gives a magnified view of FIG. 2 to further illustrate how the non-thermoplastic textile length fibers 12 are bonded by the low melting point thermoplastic fibers 10 within the recessed bond points only. The compacted area 20 as shown in FIGS. 2 and 3 illustrate that the thermoplastic fibers 10 within the recessed bond area are melted. In the process of melting the thermoplastic fibers display viscous properties of a liquid by flowing around the non-thermoplastic fibers 12 and into any void spaces within the compacted region, thus bonding and encapsulating the non-thermoplastic rayon fibers.

In addition to FIG. 3, FIG. 5, a microphotograph, illustrates further, how the low melting point thermoplastic fibers 10 encapsulates adjacent non-thermoplastic fibers 12, when they melt.

Another important factor of this layered fabric construction is that delamination of the fabric has virtually been eliminated. Delamination of a fabric is a result of insufficient bonding taking place within a fabric, and as a result the layers of fabric tend to separate. There should be approximately 10% to 40% of the surface area of the fabric recessed bonded by said heat and pressure to insure that all layers of the fabric will be bonded together. This is a distinct advantage over other prior art nonwoven fabrics.

In addition, a fabric constructed having only one outer layer, would allow the lower melting thermoplastic inner layer (away from the surface of the magnetic media) to not only be bonded to the outer layer of textile fibers, but the thermoplastic fibers may be more readily and directly bonded to, for example, a polyvinyl chloride film, such as used as the substrate in a diskette envelope. This bonding of the fabric directly to the polyvinyl chloride (PVC) film is due to the low melting thermoplastic fibers of the inner layer of the fabric being put in heat and pressure contact with the surface of the PVC film while the non-thermoplastic fibers of the outer layer are away from the surface of the PVC film. Therefore, when heat and pressure are applied to the fabric while being in surface contact with the PVC film, the thermoplastic fibers readily adhere themselves to the surface of the PVC film.

FIG. 4 shows a section of a typical finished computer diskette product to illustrate the preferred position of the present fabric 26 in relationship to the magnetic disk 24 and diskette envelope 22.

As shown in FIG. 4, the fabric of this invention is located on at least one side of the magnetic disk 24 to keep its surface clean and because of its compressible quality will fill the diskette envelope 22 without undue pressure being exerted on the magnetic media. This compressibility of the fabric reduces the torque which is required to rotate the magnetic disk 24 in a disk drive. As previously stated, because the fabric is compressible it follows the contours of the envelope and magnetic disk without imposing high pressure upon the disk which pressure would have to be overcome by increasing the torque of the driving mechanism to drive said disk. With the non-thermoplastic textile length fibers, which have low surface resistivity, against the magnetic disk low torque can be used in the drive system. Fibers with low surface resistivity are fibers, for example, that are hydrophilic or hydrophilically treated.

In addition, as shown in FIG. 4, the diskette envelope 22, magnetic disk 24 and fabric liner 26 are integral and congruent with each other, which means that each component has dimensions that have to be held in order for them to fit together. It is usually easy to hold the dimensions of a computer diskette envelope 22 and a magnetic disk 24 because they have substantial body, but it is difficult to hold liner fabric 26 dimensions due to its flexibility. The present invention overcomes this problem because it has dimensional stability. Dimensional stability means when the liner fabric 26 is cut to a specific dimension, it will retain these dimensions or shape during subsequent use, where most other fabrics may shrink somewhat. Shrinkage can be minimized with the present fabric because great care is taken in the production of the fabric to insure that it is made with a minimum amount of tension. To achieve a minimum amount of tension in the production of the liner fabric, all process equipment used in said production is operated at substantially the same line speed. In addition, it was found that the present invention fabric, when being die cut, produced a cleaner cut than other rayon/thermoplastic fabrics. The cleaner die cut is attributed to the fact that a stronger bond of the fibers is acheived when Nylon 6 fibers are used to bond the fabric. Because of the stronger bond fibers within the fabric are securely held in place, thus a substantial reduction in their movement. With the movement of the fibers eliminated the die will cut the fibers cleaner.

It is assumed and may be demonstrated, by using fibers that do not have titanium dioxide or other delusterants in the fibers, that abrasion of the magnetic disk may be minimized.

A typical example is described of the preferred embodiment of this invention. This example is illustrative of the fabrics of this invention. It should be noted that the cellulosic fibers, or outer layers of the fabric, are intended to be positioned against the magnetic media.

Example 1—The preferred embodiment of this invention is an array of fibrous layers comprising a pair of outer or surface layers of 100 percent 1.5 denier, 1 9/16 inch staple rayon fibers sandwiched around a blended inner core layer of 20 percent, 3.0 denier, 2.2 inch staple Nylon 6 fibers with a melt point between 419° F. and 430° F. and 80 percent, 1.5 denier, 1 9/16 inch staple rayon fibers, which does not melt, but is degradable. The array is then thermally bonded, by passing it through the nip of a heated calender, at discrete bonding points with a combination of 525° F. heat and 100 PLI pressure. The fabric has a dwell time in the calender nip of 4.4×10-4 seconds in contact with said heat and pressure. The weight of the fabric is 28 grams per square yard and has a thickness of 404 microns, at zero load. This fabric is capable of being compressed approximately 46 percent in thickness to 216 microns when a load of 187 grams per square centimeter is applied to the surface of the fabric.

The previously mentioned example was tested under certain conditions to determine what effect it had on reducing errors generally encountered in transferring information to or from a magnetic disk. Before testing the fabric against a magnetic disk, each disk to be used in the test was subjected to a test using a "Diskette Analysis System," made by Cloutier Design Services, to determine whether errors were inherent in the disk. Each disk tested proved to be error free. After making this assessment, the fabric in example 1 was laminated to a polyvinyl chloride (PVC) sheet, which is typical of the medium used in making a diskette envelope, and then the laminated unit was inserted into a simulated diskette drive system, along with the magnetic disk in contact therewith. The criteria the sample fabric must meet was established by ANSI (American National Standards Institute). Specifically the standard includes the wear resistant specifications of Paragraph 4.4.3 of the 4th draft of ANSI for (2) two sided double density unformulated 5.25 inch flexible disk cartridges, general, physical and magnetic requirements number X 3B 8/82-08. ANSI Standard 4.4.3 was followed, with one exception. This exception was that the read-write head was not loaded on the disk. The test were conducted for a 500 hour period which is equivalent to 9 million revolution, at 300 RPMS.

The test results showed that the fabric kept the magnetic media free from errors. The sample fabric and magnetic disk then were examined under a microscope to see if the fabric abraded the surface of the disk, and whether the disk was damaged. This examination showed no abrasion or damage.

In addition to the above test a second test comparing the strengths of rayon fibers bonded with different thermoplastic fibers was conducted. The fabrics used in this test were all thermally spot bonded at weights between 28 and 30 grams per square yard. Each fabric had the same base of Rayon fiber, but different bonding fibers, such as polyester, polypropylene and Nylon 6, to demonstrate the different strengths of each fabric. The fiber orientation of the fabrics were also the same. Each fabric was tested by subjecting a one inch wide by six inch long strip of fabric to a tensile test in an Instron tensile tester. The following are the results of the test.

| FABRIC COMPOSITION | M.D. TENSILE LB/IN | C.D. TENSILE LB/IN |
|---|---|---|
| 50% Rayon/50% Polyester | 3.9 | 0.5 |
| 77% Rayon/23% polypropylene | 3.0 | 0.5 |
| 85% Rayon/15% Nylon 6 | 6.5 | 1.4 |

The conclusion arrived at after the first test was that the fabric cleaned the magnetic media of contamination; the fabric did not contain any debris; and the fabric did not abrade the surface of the disk. The results of the second test illustrates that the strength of the present invention fabric bonded with Nylon 6 is substantially stronger (by approximately 200%) than the other tested fabrics. It should also be noted that the strength of the present invention fabric was acheived with substantially less bonding fibers (Nylon 6) than that used in the other fabrics.

The above disclosure is not meant to be limited except by the attached claims.

What is claimed is:

1. A computer diskette liner material comprising; an inner layer of Nylon 6 thermoplastic fibers, and at least one outer layer of predominantly cellulosic textile length fibers, said inner and outer layers thermally bonded together in a plurality of recessed discrete bonding points.

2. The computer diskette liner material of claim 1 wherein said outer layer is comprised of 60–0% synthetic fibers and 40–100% cellulosic fibers.

3. The computer diskette liner material of claim 1 wherein all the fibers used in said material are substantially free of delusterant.

4. The computer diskette liner material of claim 1 wherein said material has at least a 75% void volume.

5. The computer diskette liner material of claim 1 wherein said material has 10–40% of its surface area bonded.

6. In a computer diskette having a plastic container, a nonwoven fabric liner disposed therein, and a flexible magnetic disk disposed thereon, in surface contact with said nonwoven liner, wherein the improvement comprises; a nonwoven liner having an inner layer of substantially low melting point thermoplastic Nylon 6 fiber; a void volume of at least 75%; a surface bonding of 10%–40%; and at least one outer layer of predominantly non-thermoplastic cellulosic textile length fibers, said inner and outer layer thermally bonded together in a plurality of recessed discrete bonding points.

7. In a computer diskette having a plastic container, a nonwoven fabric liner disposed therein, and a flexible magnetic disk disposed thereon, in surface contact with said nonwoven liner, wherein the improvement comprises; a nonwoven liner having a homogeneous blend of Nylon 6 fibers and cellulosic fibers thermally bonded together in a plurality of recessed discrete bonding points; a void volume of at least 75%; and a surface bonding of 10%–40%.

* * * * *